US008482473B2

(12) United States Patent
Huang

(10) Patent No.: US 8,482,473 B2
(45) Date of Patent: Jul. 9, 2013

(54) PLANAR RECONFIGURABLE ANTENNA

(75) Inventor: Huan-Chu Huang, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 737 days.

(21) Appl. No.: 12/549,337

(22) Filed: Aug. 27, 2009

(65) Prior Publication Data

US 2011/0012805 A1 Jan. 20, 2011

(30) Foreign Application Priority Data

Jul. 16, 2009 (TW) ..... 98124138 A

(51) Int. Cl.
*H01Q 9/28* (2006.01)

(52) U.S. Cl.
USPC ..... 343/795; 343/815; 343/818

(58) Field of Classification Search
USPC ..... 343/700 MS, 833, 795, 815, 817, 343/818, 819, 834
See application file for complete search history.

(56) References Cited

U.S. PATENT DOCUMENTS

| | | | | |
|---|---|---|---|---|
| 6,567,055 | B1 * | 5/2003 | Oglesby | 343/795 |
| 7,050,014 | B1 | 5/2006 | Chen et al. | |
| 7,061,447 | B1 | 6/2006 | Bozler et al. | |
| 2006/0240882 | A1 * | 10/2006 | Nagy et al. | 455/575.7 |
| 2007/0195464 | A1 | 8/2007 | Kwon et al. | |
| 2010/0231451 | A1 * | 9/2010 | Noguchi et al. | 342/367 |

FOREIGN PATENT DOCUMENTS

| | | |
|---|---|---|
| CN | 1703803 | 11/2005 |
| JP | 08-037419 | 2/1996 |
| JP | 2001-313516 | 11/2001 |
| WO | 2006038432 | 4/2006 |
| WO | 2008018230 | 2/2008 |
| WO | 2008050758 | 5/2008 |

OTHER PUBLICATIONS

"Search Report of European counterpart application", issued on Oct. 21, 2009, p. 1-p. 5.
"Office Action of Japan Counterpart Application", issued on Nov. 15, 2011, p. 1-p. 2, in which the listed references were cited.
"Office Action of Taiwan Counterpart Application", issued on Jun. 14, 2012, p. 1-p. 4, in which the listed references were cited.
"First Office Action of China counterpart application" issued on Aug. 31, 2012, p. 1-p. 8, in which the listed reference was cited.

* cited by examiner

*Primary Examiner* — Hoang V Nguyen
*Assistant Examiner* — Kyana R McCain
(74) *Attorney, Agent, or Firm* — Jianq Chyun IP Office

(57) ABSTRACT

A planar reconfigurable antenna including a substrate, a metal layer, a master antenna, an auxiliary antenna and a switch set is provided. The substrate has a first surface and a second surface. The metal layer is disposed on the first surface of the substrate and the upper edge of the metal layer is in a convex arc shape. The master antenna is disposed on the substrate and partially overlaps the metal layer on a vertical plane of projection. The auxiliary antenna is disposed on the substrate and is placed opposite to the master antenna. The switch set is also disposed on the substrate and changes a connection relation of a plurality of directional devices in the auxiliary antenna to switch scanning directions of main beams generated from the planar reconfigurable antenna.

18 Claims, 5 Drawing Sheets

PLANAR RECONFIGURABLE ANTENNA

CROSS-REFERENCE TO RELATED APPLICATION

This application claims the priority benefit of Taiwan application serial No. 98124138, filed on Jul. 16, 2009. The entirety of the above-mentioned patent application is hereby incorporated by reference herein and made a part of this specification.

BACKGROUND OF THE INVENTION

1. Field of Invention

The present invention relates to an antenna. More particularly, the present invention relates to a planar reconfigurable antenna.

2. Description of Related Art

Antenna is not only a critical element in many wireless communication systems, but it also affects the overall performance of the systems. Generally speaking, tending to be subject to the affects of multiple-paths and signals on the same frequency, omni-antennas and panel-antennas may cause problems in wireless transmission and limit the system capacities.

To resolve the above-mentioned problems, technologies regarding reconfigurable antennas and smart antennas are proposed. In a wireless communication system, the system can change the parameters of a reconfigurable/smart antenna to achieve better communication quality. Examples of the parameters include direction, gain, and polarization. As a result, reconfigurable/smart antennas are wildly applied in communication systems such as digital television systems, wireless local networks, hand-hold electronic apparatuses (such as cell-phones, notebook computers, Netbooks, Smartbooks, UMPCs), and global positioning system.

However, a reconfigurable/smart antenna often has many antenna elements and a complex and enormous feeding and distribution network. Accordingly, the reconfigurable/smart antenna also has a high cost and a large size. In addition, because a reconfigurable/smart antenna can change its parameters according to the environment, its physical embodiment is generally quite complicated.

SUMMARY OF THE INVENTION

Accordingly, the present invention is directed to provide a planar reconfigurable antenna. The planar reconfigurable antenna utilizes a master antenna and an auxiliary antenna disposed on a substrate to create a corresponding coupling effect, so as to radiate a directional radio frequency (RF) signal. The planar reconfigurable antenna not only is superior in its miniaturization, but also can reduce the complexity of system embodiments of electrical apparatuses.

The present invention provides a planar reconfigurable antenna. The planar reconfigurable antenna includes a substrate, a metal layer, a master antenna, an auxiliary antenna, and a switch set. The substrate has a first surface and a second surface. The metal layer is disposed on the first surface of the substrate. An upper edge of the metal layer is in a convex arc shape. The master antenna is disposed on the substrate and partially overlaps the metal layer on a vertical plane of projection. The auxiliary antenna is disposed on the substrate and placed in front of the master antenna. The switch set is disposed on the substrate. The switch set changes a connection relation of a plurality of directors of the auxiliary antenna, so as to change a scanning direction of a beam generated by the planar reconfigurable antenna.

According to an embodiment of the present invention, the master antenna includes a first driving element and a second driving element. The first driving element is disposed on the first surface of the substrate and has a first arm and a second arm. The first arm of the first driving element is extended out from the metal layer. The second driving element is disposed on the second surface of the substrate and has a first arm and a second arm. The first arms of the first and the second driving elements overlap on the vertical plane of projection. The second arms of the first and the second driving elements are symmetric with respect to a positive direction.

According to an embodiment of the present invention, the auxiliary antenna or the directors of the master antenna include a first director, a second director, a third director, and a fourth director. The first director is disposed on the first surface of the substrate and is opposite to the second aim of the first driving element. The second director is disposed on the first surface of the substrate and electrically connected to the first director by the switch set. The third director is disposed on the second surface of the substrate and is opposite to the second arm of the second driving element. The fourth director is disposed on the second surface of the substrate and electrically connected to the third director by the switch set.

According to an embodiment of the present invention, the switch set includes a first switch and a second switch. The first switch is disposed on the first surface of the substrate and electrically connected between the first and the second directors. The second switch is disposed on the second surface of the substrate and electrically connected between the third and the fourth directors. When the first switch and the second switch are both turned off, the direction of the main beam is in the positive direction. When the first switch is turned on and the second switch is turned off, the direction of the main beam deviates to the right of the positive direction for a predetermined angle. When the first switch is turned off and the second switch is turned on, the direction of the main beam deviates to the left of the positive direction for the predetermined angle. When both of the first and second switched are turned on, two split main beams will be obtained and deviate to ±90 degrees from the positive direction.

According to an embodiment of the present invention, the planar reconfigurable antenna further includes a third to a sixth switches, a feeding line, a first route line, and a second route line. The third to the sixth switches, and the feeding line are disposed on the second surface of the substrate. The first route line is disposed on the second surface of the substrate and electrically connected between the second driving element and the feeding line through the third and the fourth switches. The second route line is disposed on the second surface of the substrate and electrically connected between the second driving element and the feeding line through the fifth and the sixth switches. The length of the second route line is shorter than the length of the first route line.

When one of the first and the second switches is turned on, the third and the fourth switches are turned off, and the fifth and the sixth switches are turned on. The signal received by the planar reconfigurable antenna will pass through the shorter second route line to the feeding line. On the contrary, when both the first and the second switches are turned off, the third and the fourth switches are turned on, and the fifth and the sixth switches are turned off. The signal received by the planar reconfigurable antenna will pass through the longer first route line to the feeding line.

According to an embodiment of the present invention, the planar reconfigurable antenna further includes a first reflecting element and a second reflecting element. The first and the second reflecting elements are disposed on the second surface of the substrate and are arranged on two sides of the first arm of the second driving element. The first and the second reflecting elements encircle the upper edge of the metal layer on the vertical plane of projection.

The present invention utilizes the coupling effect of the master and the auxiliary antennas to transmit/receive RF signals. The switch set controls the connection relations of the directors of the auxiliary antenna. Accordingly, the planar reconfigurable antenna can dynamically adjust the scanning direction of the beam according to the strength of the signal source. Hence, high communication quality is maintained. Compared with the related art, the planar reconfigurable antenna of the present invention is superior in its miniaturization, can maintain the quality of wireless communication, and can reduce the complexity of system embodiments of electrical apparatuses.

In order to make the aforementioned and other features and advantages of the present invention comprehensible, embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
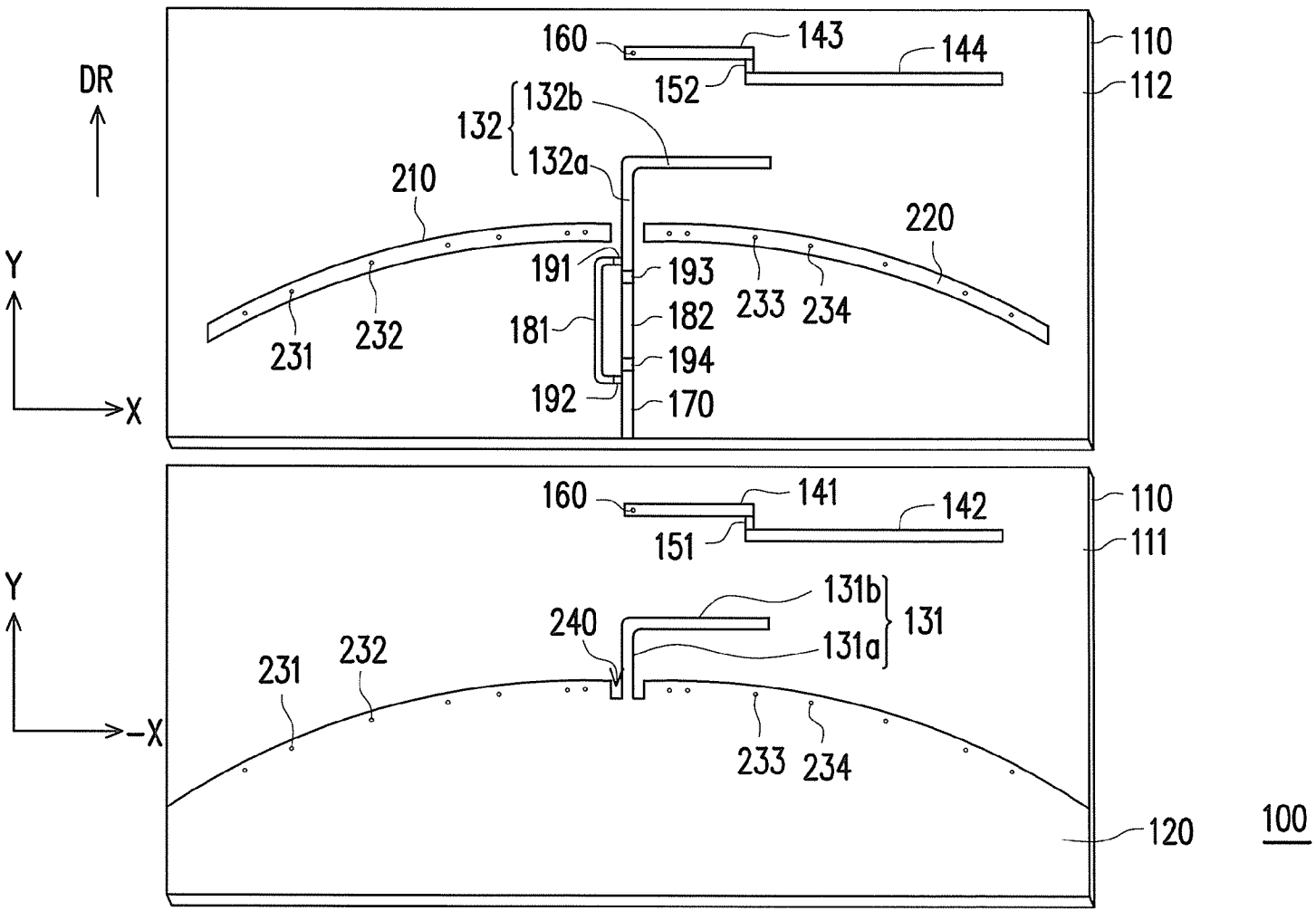
FIG. 1 is a conceptual layout diagram of a planar reconfigurable antenna according to an embodiment of the present invention.
Figure 2:
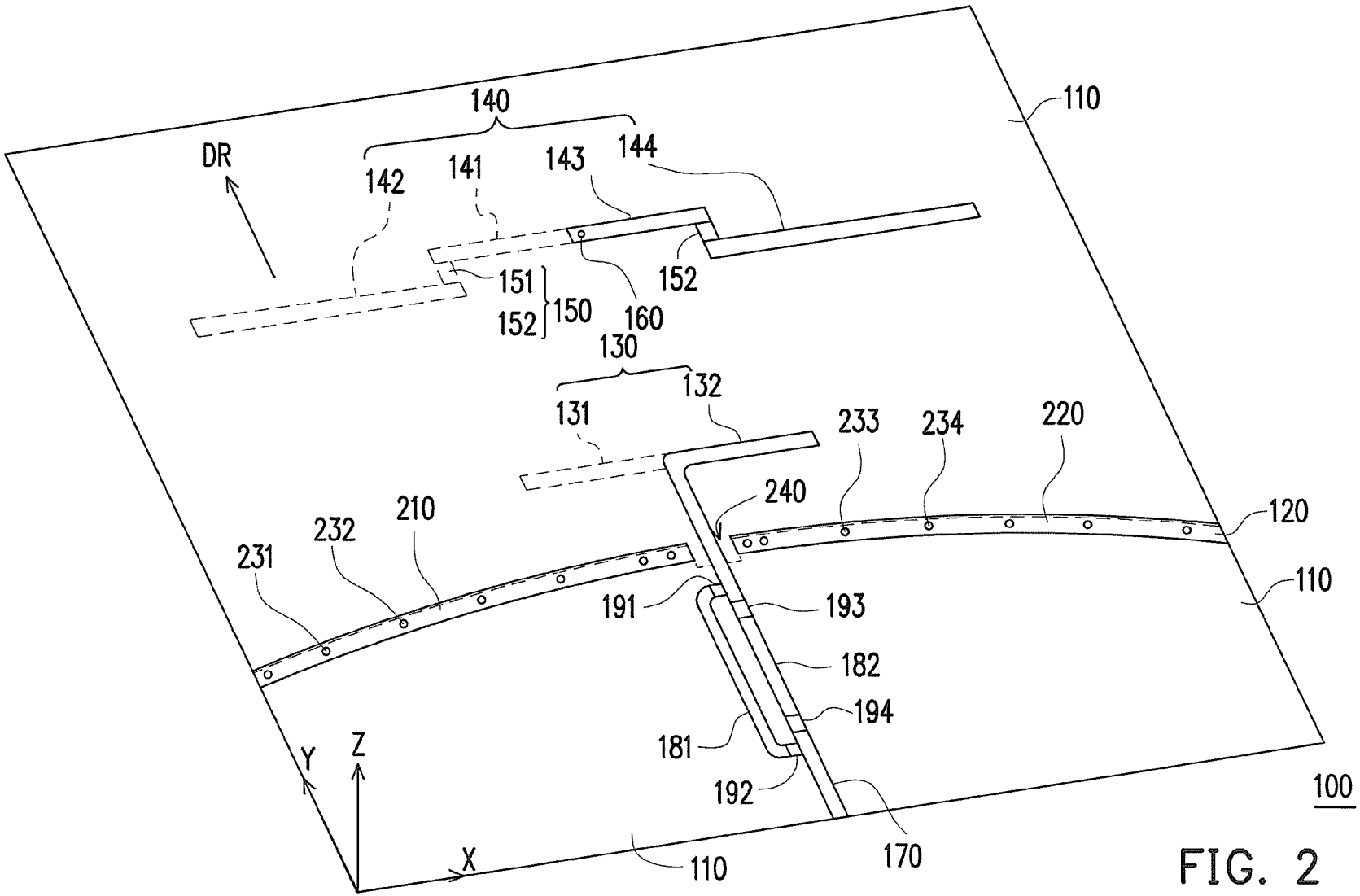
FIG. 2 is a tilted perspective diagram of the planar reconfigurable antenna of FIG. 1 on a vertical plane of projection.

FIG. 1 is a conceptual layout diagram of a planar reconfigurable antenna according to an embodiment of the present invention. The conceptual layout diagram is drawn on a plane defined by axes X and Y and on another plane defined by axes −X and Y. FIG. 2 is a tilted perspective diagram of the planar reconfigurable antenna of FIG. 1 on a vertical plane of projection. The tilted perspective diagram is drawn in a 3-dimensional space defined by axes X, Y, and Z. Please refer to both FIGS. 1 and 2, the planar reconfigurable antenna 100 includes a substrate 110, a metal layer 120, a master antenna 130, an auxiliary antenna 140, and a switch set 150. Specifically, FIG. 2 shows the tilted perspective views of the elements of the planar reconfigurable antenna 100 in the 3-dimensional space defined by axes X, Y, and Z.

Please refer to FIGS. 1 and 2. The substrate 110 has a first surface 111 and a second surface 112. The master antenna 130 includes a first driving element 131 and a second driving element 132. The auxiliary antenna 140 includes a first director 141, a second director 142, a third director 143, and a fourth director 144. The switch set 150 includes a first switch 151 and a second switch 152. The metal layer 120 is disposed on the first surface 111 of the substrate 110. The master antenna 130 and the auxiliary antenna 140 are symmetric with respect to each other and are disposed on the first surface 111 and the second surface 112 of the substrate 110. The switch set 150 is disposed on the substrate 110.

In practical applications, such as in this embodiment, the master antenna 130 can be a dipole antenna. Specifically, both the first driving element 131 and the second driving element 132 of the master antenna 130 have an L-shape and two arms. In this embodiment, the first driving element 131 has a first arm 131*a* and a second arm 131*b*. The second driving element 132 has a first arm 132*a* and a second arm 132*b*.

As shown in FIG. 1, when departed, the first driving element 131 and the second driving element 132 are almost identical. However, the first driving element 131 and the second driving element 132 are disposed on the first surface 111 and the second surface 112 of the substrate 110, respectively. Please note that in FIG. 1, the spatial relationship between the first driving element 131 and the first surface 111 is shown on the plane defined by axes −X and Y. The spatial relationship between the second driving element 132 and the second surface 112 is shown on the plane defined by axes X and Y. In addition, as show in FIG. 2, the first arms 131*a* and 132*a* of the first driving element 131 and the second driving element 132 overlap on the vertical plane of projection. The second arms 131*b* and 132*b* of the first driving element 131 and the second driving element 132 are symmetric with respect to a positive direction DR (i.e. the direction of axis Y). In addition, the first arm 131*a* of the first driving element 131, which is disposed on the first surface 111, is extended out from the metal layer 120. The master antenna 130 can radiate its maximum power along the positive direction DR, that is, the direction perpendicular to the second arm 131*b* of the first driving element 131 or the second arm 132*b* of the second driving element 132.

On the other hand, from the prospective of the auxiliary antenna 140 and the switch set 150, the first director 141 and the second director 142 of the auxiliary antenna 140 are disposed on the first surface 111 of the substrate 110, and the first director 141 is opposite to the second arm 131*b* of the first driving element 131. In addition, the first switch 151 of the switch set 150 is disposed on the first surface 111 of the substrate 110, and is electrically connected between the first director 141 and the second director 142. As a result, the connection relation between the first director 141 and the second director 142 can be changed according to whether the first switch 151 is turned on or turned off.

The third director 143 and the fourth director 144 of the auxiliary antenna 140 are disposed on the second surface 112 of the substrate 110. The third director 143 is opposite to the second arm 132*b* of the second driving element 132. In addition, the second switch 152 of the switch set 150 is disposed on the second surface 112 of the substrate 110, and is electrically connected between the third director 143 and the fourth director 144. As a result, the connection relation between the third director 143 and the fourth director 144 can be changed according to whether the second switch 152 is turned on or turned off.

Figure 3:
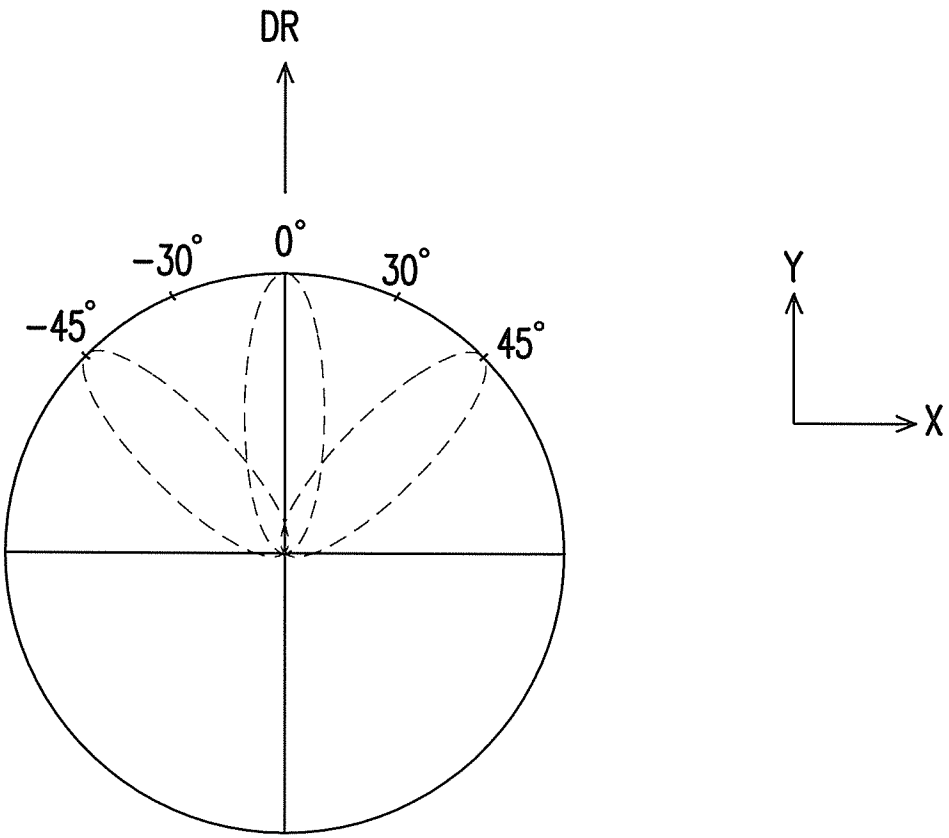
FIG. 3 is a conceptual diagram of the main beam from the planar reconfigurable antenna of FIG. 1.

Please note that when the connection relations of the first to the fourth directors 141-144 are changed, the master antenna 130 and the auxiliary antenna 140 will generate a different coupling effect, and cause the planar reconfigurable antenna 100 to generate a beam on a different direction. For example, FIG. 3 is a conceptual diagram of the main beam from the planar reconfigurable antenna 100. Please refer to both FIGS. 2 and 3. When the first switch 151 and the second switch 152 are turned off, the coupling effect between the master antenna 130 and the auxiliary antenna 140 will cause the planar reconfigurable antenna 100 to generate a main beam with the scanning direction in the positive direction DR. As is shown in FIG. 3, in this situation, the deviation angle of the main beam generated by the planar reconfigurable antenna 100 is zero degree.

When the first switch 151 is turned on and the second switch 152 is turned off, the planar reconfigurable antenna 100 will generate a main beam with the direction deviating to the right of the positive direction DR for a predetermined angle. When the first switch 151 is turned off and the second switch 152 is turned on, the planar reconfigurable antenna 100 will generate a main beam with the direction deviating to the left of the positive direction DR for the predetermined angle. Taking FIG. 3 as an example, the predetermined angle is approximately 45 degrees. When both the first switch 151 and the second switch 152 are turned on, the master antenna 130 can radiate the maximum power towards a direction perpendicular to the positive direction DR, and along two sides of the master antenna 130, that is, the deviation form the positive direction by ±90 degrees.

In other words, under the control of the first switch 151 and the second switch 152, the planar reconfigurable antenna 100 can change the directions of main beams. Accordingly, when the planar reconfigurable antenna 100 is applied in a handheld electronic apparatus, the apparatus can adaptively adjust the on/off states of the first switch 151 and the second switch 152 according to the strength of the signal source as long as the algorithm is supported, so as to ensure optimal/maximal signal receiving. Examples of the handheld electronic apparatus include cell phones, notebook computers, global positioning system (GPS) navigators, ultra mobile personal computers (UMPCs), network linkable notebooks (Netbooks), and Smartbooks. Persons of ordinary skills in the art can also apply the planar reconfigurable antenna 100 in an access point (AP) of a wireless local area network (WLAN), a smart base-station or a smart antenna system (SAS), so as to ensure optimal/maximal signal receiving. Please note that being applied in a handheld electronic apparatus is not a necessary limitation of the present invention.

For example, assume that a handheld electronic apparatus uses a traditional GPS antenna, which has a fixed radiation beam pattern. When the handheld electronic apparatus is under or near a shield, such as a viaduct or a high building, the signal transmitted by the satellite may be affected by the environment due to the different position of the handheld electronic apparatus, so that the performance of the GPS, such as positioning time and positioning accuracy, will be affected. On the contrary, the planar reconfigurable antenna 100 of the embodiment can direct to the optimal signal direction to receive the GPS signal by the beam dynamically directing the signal source. In other words, when the signal in the currently used direction is weak, the planar reconfigurable antenna 100 can veer to another direction to try to receive the better signal. Therefore, the negative effect caused by the environment is minimized and the positioning time and positioning accuracy of the GPS can be improved.

In addition, because the planar reconfigurable antenna 100 has a flat structure, it can be integrated into the handheld electronic apparatus easily. For example, the planar reconfigurable antenna 100 can be disposed on the back cover of a cell phone, or the back cover of a battery, or a printed circuit board (PCB) inside the apparatus. Because the planar reconfigurable antenna 100 has a flat structure, the size of the handheld electronic apparatus can also be minimized. Furthermore, the planar reconfigurable antenna 100 only utilizes the control of the first switch 151 and the second switch 152 to change the directional direction of the beam. Therefore, the planar reconfigurable antenna 100 further reduces the system realization complexity of the handheld electronic apparatus.

Please refer to FIGS. 1 and 2 for more details of the first to the fourth directors 141-144 of the auxiliary antenna 140. In this embodiment, the first director 141 and the third director 143 are symmetric on the vertical plane of projection with respect to the positive direction DR. The second director 142 and the fourth director 144 are also symmetric on the vertical plane of projection with respect to the positive direction DR.

As to the electrical connection, an additional via can also be used to connect the first director 141 and the third director 143. For example, the planar reconfigurable antenna 100 further includes a first via 160. The first via 160 penetrates through the substrate 110, the first director 141, and the third director 143, so as to electrically connect the first director 141 and the third director 143. On the other hand, through the first switch 151 and the second switch 152, the first director 141 and the third director 143 can electrically connect to the second director 142 and the fourth director 144, respectively. From the prospect of the auxiliary antenna 140, the first director 141 and the third director 143 are equivalent to a master radiation arm. The second director 142 and the fourth director 144 are equivalent to a left radiation aim and a right radiation arm, respectively.

Practically, the left radiation arm and the right radiation arm can have step arrangements. For example, in this embodiment, the first director 141 and the second director 142 have a downward step arrangement. Apparently, the first director 141 and the second director 142 can also have an upward step arrangement. Furthermore, the step distance of the first director 141 and the second director 142 can be between 1 to 15 millimeters. Furthermore, the left radiation arm and the right radiation arm of the auxiliary antenna 140 can have a horizontal arrangement. In other words, the first to the fourth directors 141-144 are aligned with the master arms on the same horizontal plane or line.

Practically, the lengths of the master radiation arm, the right radiation arm, and the left radiation arm of the auxiliary antenna 140 are roughly the same. In other words, the added up length of the first director 141 and the third director 143 is approximately equal to the length of the second director 142 or the fourth director 144. Furthermore, from the prospective of the auxiliary antenna 140 and the master antenna 130, the added up length of the second aim 131*b* of the first driving element 131 and the second arm 132*b* of the second driving element 132 is longer than the length of the first director 141 or the third director 143.

To further enhance the RF signal transmission quality, the planar reconfigurable antenna 100 of this embodiment further includes a feeding line 170, a first route line 181, a second route line 182, a third switch 191, a fourth switch 192, a fifth switch 193, a sixth switch 194, a first reflecting element 210, a second reflecting element 220, and a plurality of second vias 231-234. The metal layer 120 includes a notch 240. The length of the first route line 181 is longer than the length of the second route line 182. The feeding line 170 serves as a feeding area of the planar reconfigurable antenna 100, and is electrically connected to the master antenna 130. The metal layer 120 serves as a ground connection area and is electrically connected to a system ground.

The feeding line 170, the first route line 181, the second route line 182, and the third to the sixth switches 191-194 are disposed on the second surface 112 of the substrate 110. Through the third switch 191 and the fourth switch 192, the first route line 181 can be electrically connected between the second driving element 132 and the feeding line 170. Through the fifth switch 193 and the sixth switch 194, the second route line 182 can be electrically connected between the second driving element 132 and the feeding line 170. Furthermore, as the connection relations of the first to the fourth directors 141-144 are changed, the on/off states of the third to the sixth switches 191-194 are changed correspondingly. In other words, as the on/off states of the first switch 151 and the second switch 152 are changed, the on/off states of the third to the sixth switches 191-194 are changed correspondingly. Specifically, the length of the signal path, which includes the feeding line 170, the first route line 181, the second route line 182, the master antenna 130, and the auxiliary antenna 140, is adaptively tuned according to the states of the first switch 151 and the second switch 152 so as to maintain an operational frequency. Wherein, the operational frequency is maintained within a specific frequency band or on a predetermined specific frequency. Base on the design of the tuned path in accordance with switching schemes of the different switches, a decrease of the property of the wireless communication due to the operation frequency deviation can be avoided, so that the wireless performance of the handheld electronic apparatus is therefore stabilized.

For example, when one of the first switch 151 and the second switch 152 is turned on, the master radiation arm of the auxiliary antenna 140 is electrically connected to the left radiation arm or the right radiation arm. In this situation, both the third switch 191 and the fourth switch 192 are turned off, both the fifth switch 193 and the sixth switch 194 are turned on. The signal received by the planar reconfigurable antenna 100 will be passed to the feeding line 170 through the shorter second route line 182. Similarly, when both of the first switch 151 and the second switch 152 are turned on, the master radiation arm of the auxiliary antenna 140 is electrically connected to the left radiation arm and the right radiation arm at the same time. In this situation, both the third switch 191 and the fourth switch 192 are turned off, both the fifth switch 193 and the sixth switch 194 are turned on. The signal received by the planar reconfigurable antenna 100 will be passed to the feeding line 170 through the shorter second route line 182.

On the other hand, when both the first switch 151 and the second switch 152 are turned off, the master radiation arm of the auxiliary antenna 140 is electrically connected to neither the left radiation arm nor the right radiation arm. In this situation, the third switch 191 and the fourth switch 192 are turned on, but the fifth switch 193 and the sixth switch 194 are turned off. The signal received by the planar reconfigurable antenna 100 will be passed to the feeding line 170 through the longer first route line 181.

Please refer to FIGS. 1 and 2. The first reflecting element 210 and the second reflecting element 220 are disposed on the second surface 112 of the substrate 110, and are arranged on two sides of the first arm 132*a* of the second driving element 132. In this embodiment, the first reflecting element 210 and the second reflecting element 220 have strip shapes. In addition, when the first reflecting element 210 and the second reflecting element 220 are projected perpendicular onto the first surface 111 of the substrate 110, the projections of the reflecting elements are around the upper edge of the metal layer 120 and are close to the second arm 131. Furthermore, the surrounding shape of the metal layer 120 is similar to the shape of the substrate 110, and has a polygon (such as a rectangle) pattern. Accordingly, the first reflecting element 210 and the second reflecting element 220 can also have strip shapes. Viewing from the top view angle of FIG. 1, i.e. from +Z direction toward −Z direction, the aforementioned surrounding includes the upper edge, the lateral sides, and the bottom. To make the planar reconfigurable antenna 100 have a beam with a broader directional angle, the upper edge of the metal layer 120 has a convex arc shape, this is, the upper edge of the metal layer extends out toward the DR direction (i.e. +Y direction), wherein the curve of the extended-out metal layer is an arc shape. The first reflecting element 210 and the second reflecting element 220 also have a convex arc shape along the upper edge of the metal layer 120. As a result, the arc-shaped metal layer 120, the first reflecting element 210, and the second reflecting element 220 can increase the angle of the main beam, generated by the planar reconfigurable antenna 100, deviated from the positive direction DR.

Figure 4:
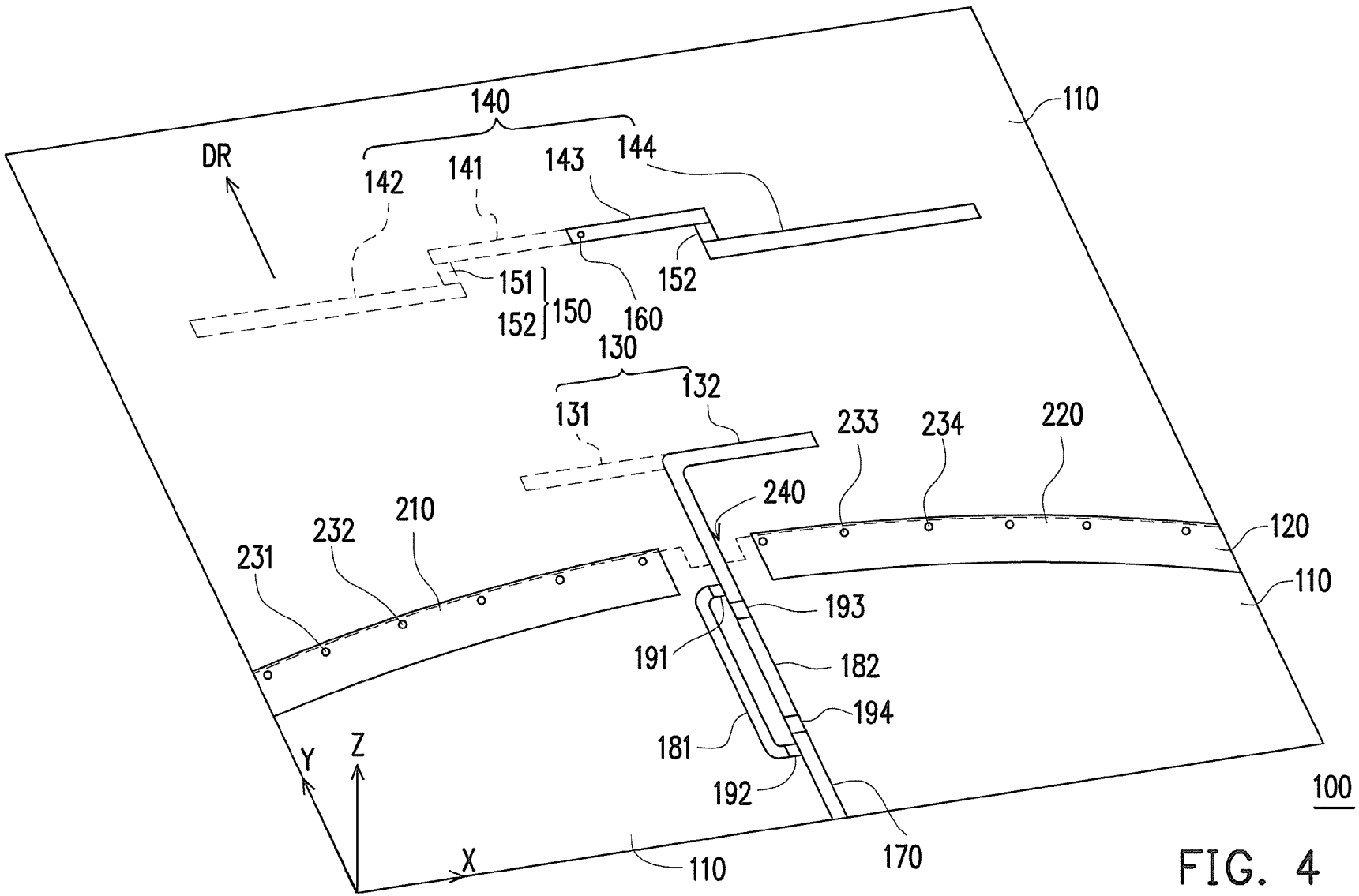
FIG. 4 is another tilted perspective diagram of the planar reconfigurable antenna of FIG. 1 on the vertical plane of projection.
Figure 5:
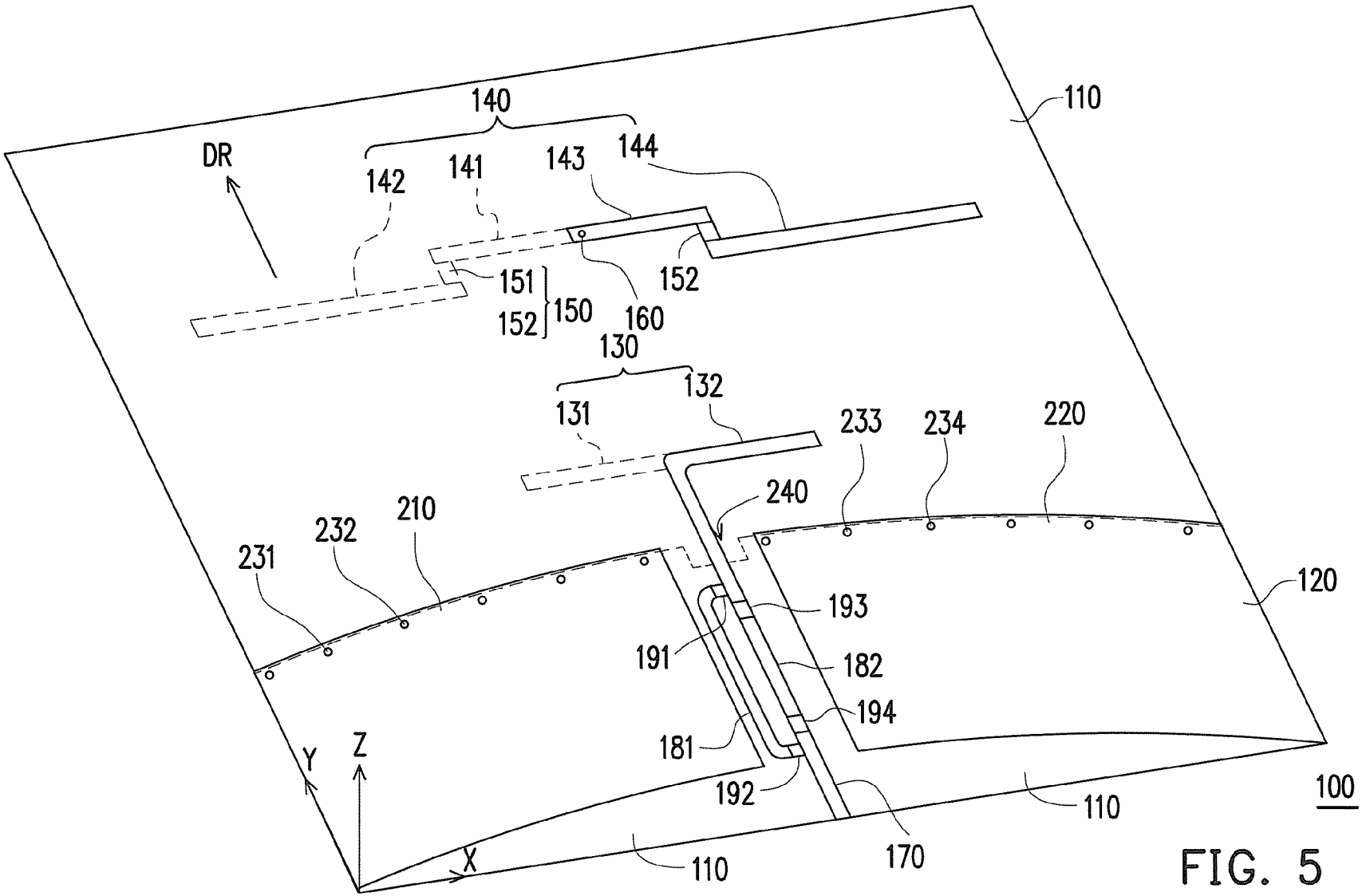
FIG. 5 is yet another tilted perspective diagram of the planar reconfigurable antenna of FIG. 1 on the vertical plane of projection.

The first reflecting element 210 and the second reflecting element 220 are not limited to have strip shapes. They can also have polygon patterns on the substrate 110. Please note that the first reflecting element 210 and the second reflecting element 220 cannot contact the feeding line 170. FIGS. 4 and 5 are conceptual layout diagrams showing different embodiments of the first reflecting element 210 and the second reflecting element 220. In FIG. 4, the first reflecting element 210 and the second reflecting element 220 extend for a short distance towards a direction opposite to the DR direction. In FIG. 5, the first reflecting element 210 and the second reflecting element 220 extend for a longer distance towards a direction opposite to the DR direction. The embodiment shown in FIG. 5 provides the planar reconfigurable antenna 100 with a broader main beam angles and better directivities.

Please refer to both FIGS. 1 and 3. Based on the well-known technique, if the first reflecting element 210, the second reflecting element 220, and the upper edge of the metal layer 120 have rectangular shapes, the main beam generated by the planar reconfigurable antenna 100 can deviate to the right or left of the positive direction DR for 30 degrees. If the first reflecting element 210, the second reflecting element 220, and the upper edge of the metal layer 120 have arc shapes, the beam generated by the planar reconfigurable antenna 100 can deviate to the right or left of the positive direction DR for approximately 45 degrees. Apparently, the improvement in the structures of the elements gives the planar reconfigurable antenna 100 a broader main beam scanning angles.

The first reflecting element 210 and the second reflecting element 220 mainly reflect the radiation energy comes from the second driving element 132 on the second surface 112. The metal layer 120 mainly reflects the radiation energy comes from the first driving element 131 on the first surface 110. However, because energy radiation is almost in all directions and is difficult to control, the first reflecting element 210 and the second reflecting element 220 may also reflect some radiation energy comes from the first surface 110. Likewise, the metal layer 120 may also reflect some radiation energy comes from the second surface 112. As a result, some energy will penetrate through the substrate 110 and radiate towards the direction opposite to the DR direction (i.e. the −Y direction). Losing this energy will to some extent affects the performance of the planar reconfigurable antenna 100.

To alleviate the energy losing effect, the embodiments of the present invention can further include a plurality of vias. For example, in FIGS. 1 and 2, second vias 231-234 either penetrate through the metal layer 120, the substrate 110, and the first reflecting element 210, or penetrate through the metal layer 120, the substrate 110, and the second reflecting element 220. The vias have the same effect as the aforementioned reflecting elements and the metal layer. Specifically, the vias can reflect a part of the energy penetrating through the substrate and enhance the directivities or the front-to-back ratios of the planar reconfigurable antenna 100. Therefore, the additional vias 231-234 give the planar reconfigurable antenna 100 broader beam scanning angles and better directivities of main beams. Please note that there can be any number of vias. The number of vias can be determined according to the design requirements, the cost concerns of the planar reconfigurable antenna 100. A person of ordinarily skills in the art can determine the location(s) of the additional via(s) to optimize the performance of the planar reconfigurable antenna 100. With respect to electrical connection, the first reflecting element 210 or the second reflecting element 220 can be electrically connected to the metal layer 120 through the second vias 231-234. On the other hand, the first arm 131*a* of the first driving element 131 is disposed on the center of the notch 240, to enhance the matching effect of the master antenna 130.

The planar reconfigurable antenna of the present invention uses the coupling effect generated by a master antenna and an auxiliary antenna to transmit/receive signals. A master radiation arm of the auxiliary antenna can be electronically connected to a left radiation arm or a right radiation arm through the corresponding switches. As a result, the planar reconfigurable antenna can dynamically adjust the beam directional direction according to the strength of a received signal. Accordingly, the planar reconfigurable antenna can direct to the optimal/strongest signal to achieve a good communication quality. In addition, the planar reconfigurable antenna not only is superior in its miniaturized size but also can alleviate the complexity in system realization of electronic apparatuses.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A planar reconfigurable antenna, comprising:

a substrate, having a first surface and a second surface;

a metal layer, disposed on the first surface, an upper edge of the metal layer being in a convex arc shape, wherein the metal layer is electrically connected to a system ground and comprises a notch;

a master antenna, disposed on the substrate and partially overlapping the metal layer on a vertical plane of projection, wherein the master antenna is symmetric with respect to a positive direction and the master antenna comprises:

a first driving element, disposed on the first surface of the substrate and extended out from the notch of the metal layer; and a second driving element, disposed on the second surface of the substrate;

an auxiliary antenna, disposed on the substrate and placed opposite to the master antenna along the positive direction; and a switch set, disposed on the substrate, the switch set changing a connection relation of a plurality of directors of the auxiliary antenna to switch a direction of main beams generated from the planar reconfigurable antenna.

2. The planar reconfigurable antenna of claim 1, wherein:

the first driving element has a first arm and a second arm, the second driving element has a first arm and a second arm, the first arms of the first and the second driving elements overlap on the vertical plane of projection, and the second arms of the first and the second driving elements are symmetric with respect to the positive direction.

3. The planar reconfigurable antenna of claim 2, wherein the directors of the auxiliary antenna comprise:

a first director, disposed on the first surface of the substrate and being opposite to the second arm of the first driving element;

a second director, disposed on the first surface of the substrate, and electrically connected to the first director by the switch set;

a third director, disposed on the second surface of the substrate and being opposite to the second ann of the second driving element; and a fourth director, disposed on the second surface of the substrate, and electrically connected to the third director by the switch set.

4. The planar reconfigurable antenna of claim 3, wherein the first and the third directors are symmetric on the vertical plane of projection with respect to the positive direction, and the second and the fourth directors are also symmetric on the vertical plane of projection with respect to the positive direction.

5. The planar reconfigurable antenna of claim 4, wherein the first and the third directors, and the second and the fourth directors have upward or downward step arrangements.

6. The planar reconfigurable antenna of claim 5, wherein the distance between the first and the third directors, and the distance between the second and the fourth directors are between 1 to 15 millimeters.

7. The planar reconfigurable antenna of claim 4, wherein the first, the second, the third, and the fourth directors are aligned with same the plane or a line.

8. The planar reconfigurable antenna of claim 3, wherein the added up length of the first and the third directors is roughly the same as the length of either the second director or the fourth director.

9. The planar reconfigurable antenna of claim 8, wherein the added up length of the second arms of the first and the second driving elements is longer than the length of either the first director or the third director.

10. The planar reconfigurable antenna of claim 3, further comprising:

a first via, penetrating through the substrate, the first director, and the third director, the first via electrically connecting the first and the third directors.

11. The planar reconfigurable antenna of claim 3, wherein the switch set comprises:

a first switch, disposed on the first surface of the substrate and electrically connected between the first and the second directors; and a second switch, disposed on the second surface of the substrate and electrically connected between the third and the fourth directors;

wherein when the first switch and the second switch are both turned off, the direction of the main beam is in the positive direction; when the first switch is turned on and the second switch is turned off, the direction of the main beam deviates to the right of the positive direction for a predetermined angle; when the first switch is turned off and the second switch is turned on, the direction of the main beam deviates to the left of the positive direction for the predetermined angle; when the first switch and the second switch are both turned on, two split main beams will be obtained and deviate to ±90 degrees from the positive direction.

12. The planar reconfigurable antenna of claim 11, wherein the predetermined angle is approximately 45 degrees.

13. The planar reconfigurable antenna of claim 11, further comprising:

a third to a sixth switches, disposed on the second surface of the substrate, wherein the second driving element is electrically connected to a first end of the third switch and a first end of the fifth switch;

a feeding line, disposed on the second surface of the substrate, wherein the feeding line is electrically connected to a first end of the fourth switch and a first end of the sixth switch;

a first route line, disposed on the second surface of the substrate, wherein the first route line is electrically connected to a second end of the third switch and a second end of the fourth switch; and a second route line, disposed on the second surface of the substrate, wherein the second route line is electrically connected to a second end of the fifth switch and a second end of the sixth switch, and the length of the second route line is shorter than the length of the first route line;

wherein, when one of the first and the second switches is turned on, the third and the fourth switches are both turned off, and the fifth and the sixth switches are both turned on; when both of the first and the second switches are turned on, the third and the fourth switches are both turned off, and the fifth and the sixth switches are both turned on; when the first and the second switches are both turned off, the third and the fourth switches are both turned on, and the fifth and the sixth switches are both turned off.

14. The planar reconfigurable antenna of claim 2, wherein the first arm of the first driving element is extended out from the notch of the metal layer towards the positive direction, and the first arm of the first driving element is disposed around the center of the notch.

15. The planar reconfigurable antenna of claim 2, further comprising a first reflecting element and a second reflecting element, the first and the second reflecting elements being disposed on the second surface of the substrate and arranged on two sides of the first arm of the second driving element, the first and the second reflecting elements encircling the upper edge of the metal layer on the vertical plane of projection.

16. The planar reconfigurable antenna of claim 15, further comprising a plurality of second vias, either penetrating through the metal layer, the substrate, and the first reflecting element, or penetrating through the metal layer, the substrate, and the second reflecting element, so as to connect the first reflecting element or the second reflecting element to the metal layer.

17. The planar reconfigurable antenna of claim 1, further comprising a first reflecting element, a second reflecting element, and a feeding line, disposed on the second surface of the substrate, wherein the first and the second reflecting elements are arranged on two sides of the master antenna, the feeding line is electrically connected to the master antenna, the first and the second reflecting elements have a polygon pattern but do not contact the feeding line.

18. The planar reconfigurable antenna of claim 1, wherein the planar reconfigurable antenna is applied in a handheld electronic apparatus, an access point of a wireless local area network, a smart base station, or a smart antenna system.

* * * * *